US007523930B2

(12) United States Patent
Kang

(10) Patent No.: US 7,523,930 B2
(45) Date of Patent: Apr. 28, 2009

(54) PAPER FEEDING APPARATUS OF AN IMAGE FORMING APPARATUS AND CONTROL METHOD THEREOF

(75) Inventor: Hoon Kang, Hwaseong-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 344 days.

(21) Appl. No.: 11/042,513

(22) Filed: Jan. 26, 2005

(65) Prior Publication Data

US 2005/0236760 A1 Oct. 27, 2005

(30) Foreign Application Priority Data

Apr. 27, 2004 (KR) ..... 10-2004-0028990

(51) Int. Cl.
*B65H 1/18* (2006.01)

(52) U.S. Cl. ..... 271/152; 271/126

(58) Field of Classification Search ..... 271/126, 271/127, 152, 154, 155
See application file for complete search history.

(56) References Cited

U.S. PATENT DOCUMENTS 4,919,410 A * 4/1990 Robinson et al. ..... 399/45
5,653,434 A * 8/1997 Petocchi et al. ..... 271/122
5,678,814 A * 10/1997 Yokoyama et al. ..... 271/9.05
5,839,015 A * 11/1998 Faguy et al. ..... 399/23
6,102,389 A * 8/2000 Sakurai et al. ..... 271/121
6,247,695 B1 * 6/2001 Linder et al. ..... 271/265.04

FOREIGN PATENT DOCUMENTS

| | | |
|---|---|---|
| JP | 06-179544 | 6/1994 |
| JP | 08-073055 | 3/1996 |
| JP | 09-278196 | 10/1997 |
| JP | 11-217124 | 8/1999 |
| JP | 2000-095360 | 4/2000 |
| JP | 2000-191154 | 7/2000 |
| KR | 1998-29916 | 7/1998 |
| KR | 1999-80769 | 11/1999 |

* cited by examiner

*Primary Examiner*—Patrick H Mackey
*Assistant Examiner*—Michael C McCullough
(74) *Attorney, Agent, or Firm*—Stanzione & Kim, LLP

(57) ABSTRACT

A paper feeding apparatus includes a paper loading plate, a paper feeding section with a pick-up roller to pick up and to feed the papers loaded on the paper loading plate one by one, a lifter to lift the paper loading plate to a pick-up roller side of the paper feeding section, a position sensor unit to sense whether an uppermost one of the papers is positioned at a pick-up position, a paper quantity sensor unit to sense the quantity and/or weight of the papers loaded on the paper loading plate, and a controller to control a lift driving time period T of the lifter to drive the lifter from a time that the uppermost one of the papers is positioned at the pick-up position to a point of time where the lifter is stopped.

47 Claims, 7 Drawing Sheets

PAPER FEEDING APPARATUS OF AN IMAGE FORMING APPARATUS AND CONTROL METHOD THEREOF

CROSS-REFERENCE TO RELATED APPLICATIONS

This application claims the benefit of Korean Patent Application No. 2004-28990 filed Apr. 27, 2004, in the Korean Intellectual Property Office, the disclosure of which is incorporated herein in its entirety by reference.

BACKGROUND OF THE INVENTION

1. Field of the Invention

The present general inventive concept relates to a paper feeding apparatus of an image forming apparatus (e.g., a laser beam printer, a copier, an ink-jet printer or a photo-printer), and in particular, to a paper feeding apparatus of an image forming apparatus having a lifter to lift a paper loading plate loaded with sheets of paper so that a top of the sheets of paper loaded on the paper loading plate comes in contact with a pick-up roller with a constant pressure. The present general inventive concept also relates to a method of controlling the paper feeding apparatus.

2. Description of the Related Art

In general, an image forming apparatus, such as a printer or a copier, is provided with a paper feeding apparatus loaded with and receiving a plurality of sheets of paper to sequentially feed the loaded sheets of paper into a body of the image forming apparatus.

FIG. 1 illustrates an example of a conventional paper feeding apparatus 10 of an image forming apparatus.

The paper feeding apparatus 10 comprises a cassette 12 removably attached to a side of a body 11 of the paper feeding apparatus 10 and being loaded with a plurality sheets of paper S, a pick-up roller assembly 13 having a pick-up roller 14 for picking up and feeding the sheets of paper S loaded in the cassette 12 into the body 11, a knock-up plate (paper loading plate) 21 rotatably installed within the cassette 12 to lift leading edges of the sheets of paper S toward the pick-up roller assembly 13, a lifter 15 for pivoting the paper loading plate 21 toward the pick-up roller 14 side of the pick-up roller assembly 13 so that an uppermost one of the sheets of paper S is positioned at a pick-up position where a top of the sheets of paper S comes in contact with the pick-up roller 14 with a constant pressure, and a position sensor unit 30 for sensing whether the uppermost one of the sheets of paper S is positioned at the pick-up position.

The paper loading plate 21 is pivotally supported on a hinge bracket 25 by a hinge axle 26.

The lifter 15 comprises a lifting plate 16 for lifting the paper loading plate 21, and a driving motor 17 for pivoting the lifting plate 16.

A fixing part 18 is formed at one end of the lifting plate 16, wherein the fixing part 18 is fixedly connected to a first end 20*a* of a power transmission shaft 20 (FIGS. 2A and 2B). The power transmission shaft 20 is pivotally supported in the cassette 12 and projected out of the cassette 12.

As illustrated in FIGS. 2A and 2B, the driving motor 17 comprises a driving axle 17*a* and a coupling 23 provided at an end of the driving axle 17*a*, wherein the coupling 23 engages a second end 20*b* of the power transmission shaft 20 when the cassette 12 is inserted into the body 11, and the coupling 23 transmits a driving force of the driving motor 17 to the lifting plate 16 through the power transmission shaft 20.

The position sensor unit 30 comprises a first sensing lever 34 projecting from an end of a body 13*a* of the pick-up roller assembly 13, and a first optical sensor 31 having a first light emitting part 32 and a first light receiving part 33, which are mounted on a printed circuit board array (PBA) 50 (FIG. 3) opposite to the first sensing lever 34.

As illustrated in FIGS. 2A and 2B, the paper feeding apparatus 10 further comprises a pick-up roller lifting member 40 which lowers the pick-up roller 14 of the pick-up roller assembly 13 toward the cassette 12 to a position represented by a two-dot chain line (FIG. 3) when the cassette 12 is inserted into the body 11, and separates the pick-up roller 14 of the pick-up roller assembly 13 from the cassette 12 to a position represented by a one-dot chain line (FIG. 3) when the cassette 12 is removed from the body 11.

The pick-up roller lifting member 40 comprises a lifting guide 41 arranged in the body 11 to be moved by the cassette 12 and provided with a guide surface 43 for guiding the body 13*a* of the pick-up roller assembly 13 to ascend or descend, a compression spring 45 arranged between a sub-frame 11*a* and the body 13*a* of the pick-up roller assembly 13 to elastically compress the body 13*a* of the pick-up roller assembly 13 so that the body 13*a* of the pick-up roller assembly 13 comes in contact with the guide surface 43 of the lifting guide 41, and a tension spring 44 interposed between the lifting guide 41 and the sub-frame 11*a* to return the lifting guide 41 to its original position, thereby lifting the pick-up roller assembly 13, when the cassette 12 is removed.

The pick-up roller lifting member 40 may employ a configuration in which the pick-up roller lifting member 40 is mounted in relation to the pick-up roller assembly 13 so that the pick-up roller assembly 13 is raised or lowered by the pick-up roller lifting member 40, instead of being mounted in relation to the body 11 so that the pick-up roller assembly 13 is raised or lowered by the cassette 12, as described above.

The following is a description of the operation of the conventional paper feeding apparatus 10 of the image forming apparatus, as described above.

If the cassette 12 loaded with the sheets of paper S is inserted into the body 11 as illustrated in FIG. 2A, a projecting step 42 of the lifting guide 41 is pushed in a direction indicated by an arrow A by a front end of the cassette 12.

As a result, the pick-up roller assembly 13 positioned above the cassette 12 as represented by the one-dot chain line in FIG. 3 descends in a direction indicated by arrow B along the guide surface 43 of the lifting guide 41 (FIG. 2B) to the position depicted by two-dot chain lines in FIG. 3 while being pivoted about a pivot axle 13*b* (FIG. 1) by the compression spring 45.

Thereafter, when the cassette 12 is completely inserted into the body 11, the pick-up roller assembly 13 is in a state in which a part of the pick-up roller 14 is positioned above the leading edges of the sheets of paper S in the cassette 12, and the second end 20*b* of the power transmission shaft 20 projecting from the front end of the cassette 12 engages the coupling 23 provided at the end of the driving axle 17*a* of the driving motor 17.

In this state, the driving motor 17 is driven to rotate the power transmission shaft 20, so that the lifting plate 16 is upwardly pivoted, thereby lifting the paper loading plate 21.

As the paper loading plate 21 is lifted up, the top of the sheets of paper S loaded on the paper loading plate 21 comes in contact with and upwardly push the pick-up roller 14 against the compression spring 45. Accordingly, the body 13*a* of the pick-up roller assembly 13 is upwardly pivoted about the pivot axle 13*b*.

When the pick-up roller assembly 13 is pushed up and positioned where the top of the sheets of paper S comes in contact with the pick-up roller 14 with a constant pressure, the first sensing lever 34, which is disposed at an end of the body 13*a* of the pick-up roller assembly 13, is arranged between the first light emitting part 32 and the first light receiving part 33 of the first optical sensor 31. This position is represented by a solid line in FIG. 3. Accordingly, the first optical sensor 31 produces an "OFF" signal.

As the first optical sensor 31 produces the "OFF" signal, a controller (not shown) stops the driving motor 17 and drives the pick-up roller 14 using a driving source (not shown) connected to the pick-up roller 14 using a gear train (not shown) so that the sheets of paper S in contact with the pick-up roller 14, i.e., the papers loaded in the cassette 12, are sequentially fed into the body 11 one by one beginning with the uppermost one of the sheets of paper S.

The conventional paper feeding apparatus 10, as described above, typically employs a stepping motor or a DC motor as the driving motor 17 for rotating the lifting plate 16.

With the stepping motor, if a number of steps of the stepping motor are obtained and the number of steps for stopping the stepping motor after the first optical sensor 31 of the position sensor unit 30 is turned "OFF" has been previously set, the stepping motor is properly stopped after it rotates by the set number of steps from a point in time when the first optical sensor 31 is turned "OFF." The stepping motor rotates the set number of steps regardless of a load on the paper loading plate 21, i.e., the quantity or weight of sheets of paper S loaded in the cassette 12. Therefore, although it may be advantageous that a rotating angle of the lifting plate 16 and the paper loading plate 21, i.e., the pick-up position of the sheets of paper S, can be properly controlled, a rotational ratio of the stepping motor is high, and construction and installation of the stepping motor is complicated, because the stepping motor requires a large installation space.

On the other hand, construction and installation of the DC motor is relatively simple, and an installation space can be minimized. Additionally, the price of the DC motor is inexpensive. However, a number of revolutions of the DC motor can vary depending on a quantity or weight of the sheets of paper S loaded on the paper loading plate 21.

More particularly, the weight of 500 sheets of A3 papers is about 4.9 kilograms (kg), the weight of one sheet of A5 paper is about 2 grams (g), and the weight of the paper loading plate 21 is about 200 g. Therefore, the DC motor lifts any weight in a range of about 200 g to about 5.2 kg with a constant velocity.

However, because the number of revolutions of the DC motor of low capacity and low price varies depending on the quantity or weight of the sheets of paper S, a time period required for stopping the DC motor after the first optical sensor 31 is turned "OFF" also varies depending on the weight. As a result, a rotating angle of the paper loading plate 21, i.e., the lifting height, will also vary according to the quantity or the weight of the sheets of paper S.

If a lifting height of the paper loading plate 21 varies as described above, a frictional pressure between the pick-up roller 14 and the paper loading plate 21 or the sheets of paper S will vary. These variations cause the conventional paper feeding apparatus 10 to be unreliable.

According to an experiment, with 500 sheets of A3 papers, the lifting height of the paper loading plate 21 was 72 mm, and the frictional force produced between the pick-up roller 14 and the paper loading paper loading plate 21 or the sheets of paper S was 100 gram-force (go), and with one sheet of A3 paper, the lifting height of the paper loading plate 21 was 73.5 millimeters (mm) and the frictional force produced was between the pick-up roller 14 and the paper loading plate 21 or the sheets of paper S was 160 go.

Because the frictional force directly affects a feeding force of the uppermost one of the sheets of paper S, the pick-up roller 14 may not be able to pick up the uppermost one of the sheets of paper S. In addition, other pick-up problems, such as jamming or overlapped feeding of the sheets of paper S can be caused if the frictional force produced is outside a previously set range.

To solve these problems, a method can be considered in which an encoder is provided with the DC motor to calculate a difference of velocity depending on the quantity or the weight of the sheets of paper S and the rotation of the DC motor. The quantity or the weight of the sheets of paper S is compensated for based on the calculation so that the DC motor is additionally rotated. However, this method has a problem in that the manufacturing costs are increased because it becomes necessary to provide the encoder.

SUMMARY OF THE INVENTION

The present general inventive concept provides a paper feeding apparatus of an image forming apparatus and a method of controlling the same, in which a driving time period T of a lifter includes a time period from a first time that a position sensor senses that loaded papers are in a pick-up position until a second time that the lifter is stopped, and the driving time period T is controlled by placing a weighting value, which is varied depending on a quantity and/or a weight of the loaded papers sensed by a paper quantity sensor unit, wherein a contact pressure between a top of the loaded papers and a pick-up roller is maintained constant during a time in which the pick-up roller picks up the loaded papers regardless of the quantity and/or the weight of loaded papers. Thus, jamming and overlapped feeding of papers can be prevented.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a paper feeding apparatus of an image forming apparatus comprising a paper loading plate that is loaded with papers and is pivotable up and down, a paper feeding section with a pick-up roller to pick up and to feed the papers loaded on the paper loading plate one by one, a lifter to pivot the paper loading plate toward a pick-up roller side of the paper feeding section so that an uppermost one of the papers loaded on the paper loading plate is positioned at a pick-up position where a top of the papers comes into contact with the pick-up roller with a constant pressure, a position sensor unit to sense whether the uppermost paper is positioned at the pick-up position, a paper quantity sensor unit to sense a quantity and/or a weight of the papers loaded on the paper loading plate, and a controller to control a lift driving time period T of the lifter that includes a time period from a first time that the position sensor senses that the uppermost one of the papers is at the pick-up position until a second time that the lifter is stopped by placing a weight value, which is varied depending on the quantity and/or the weight of the papers sensed by the paper quantity sensor unit.

The paper quantity sensor unit may comprise a sensing actuator mounted in relation to the lifter so that the sensing actuator is actuated by the lifter, and at least one sensor mounted in relation to the sensing actuator so that the at least one sensor is activated by the sensing actuator.

The lifter may comprise a driving motor and a lifting plate provided with a power transmission shaft at one end thereof, which is coupled to a driving axle of the driving motor so that the lifting plate is pivoted by the driving motor to lift the paper loading plate. The sensing actuator may comprise an actuating lever disposed on the power transmission shaft of the lifting plate, a sensing lever disposed adjacent to the actuating lever and mounted to be pivoted by the actuating lever, and a sensing lever returning unit to return the sensing lever to its original position after the sensing lever is actuated by the actuating lever. The sensing lever returning unit may comprise an elastic spring arranged to elastically compress the sensing lever in such a manner that the sensing lever maintains contact with the actuating lever.

In addition, the sensor may comprise first and second optical sensors mounted with a predetermined space therebetween, and each of the first and second optical sensors has a light emitting part and a light receiving part mounted opposite to the sensing lever, so that the light emitting part and the light receiving part may be activated by the sensing lever.

The controller determines the lift driving time period T by selecting a driving time period value corresponding to the quantity and/or the weight of the papers sensed by the paper quantity sensor unit from a plurality of values of driving time periods T of the lifter that are previously stored to correspond to a plurality of quantities and/or weights of papers.

The foregoing and/or other aspects and advantages of the present general inventive concept may also be achieved by providing a method of controlling a paper feeding apparatus of an image forming apparatus, the method comprising lifting a paper loading plate having papers loaded thereon toward a pick-up roller side of a paper feeding section so that an uppermost one of the papers loaded on the paper loading plate is positioned at a pick-up position such that the uppermost paper comes into contact with a pick-up roller with a constant pressure, determining a lifting time period T of the paper loading plate that includes a period from a first time that the uppermost one of the papers is in the pick-up position until a second time that the paper loading plate stops the lifting movement according to a quantity and/or a weight of the papers loaded on the paper loading plate, and lifting the paper loading plate for the determined lifting time period T after the uppermost paper is positioned at the pick-up position.

The determining of the lifting time period T may be performed by determining whether the uppermost one of the papers is positioned at the pick-up position while the paper loading plate is being lifted, determining the quantity and/or the weight of the papers loaded on the paper loading plate if it is determined that the uppermost one of the papers is positioned at the pick-up position, and determining the lifting time period T of the paper loading plate by placing a weight value, which is varied depending on the determined quantity and/or weight of the papers.

The determining of the quantity and/or the weight of the papers loaded on the paper loading plate may be performed by determining whether the quantity and/or the weight of the papers falls in one of at least two predetermined ranges. Determining the lifting time period T of the paper loading plate may be performed by selecting a value corresponding to the quantity and/or the weight of the papers from among a plurality of values of lifting time periods of the paper loading plate that are previously determined to correspond to the at least two predetermined ranges. The at least two predetermined ranges may comprise fractions of a maximum capacity of paper loadable on the paper loading plate and may include quantities and/or weights below 25%, 25%, 50%, 75% and 100%. The corresponding values of the lifting time periods T of the paper loading plate may be 0 ms, 10 ms, 20 ms, 30 ms and 40 ms, respectively.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
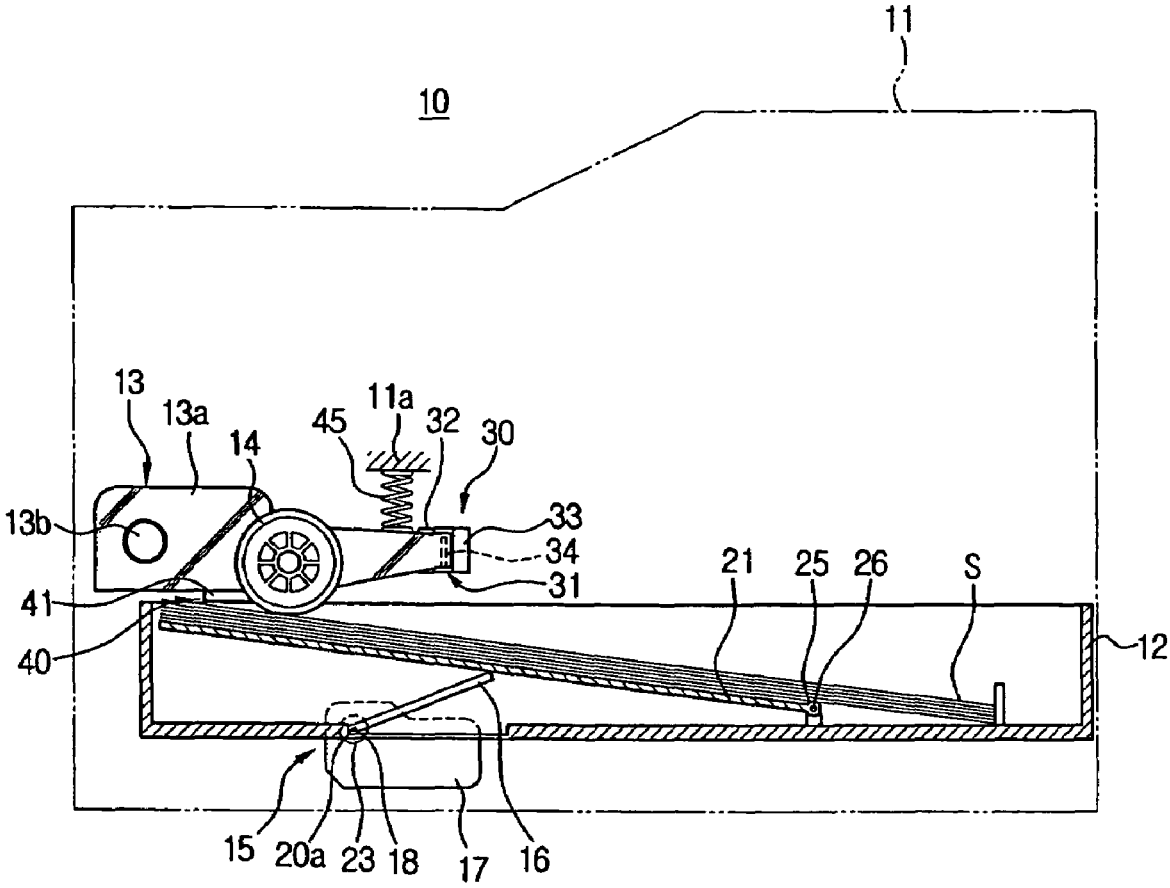
FIG. 1 (PRIOR ART)
FIG. 1 is a partial sectional view of a conventional paper feeding apparatus of an image forming apparatus.
Figure 2A:
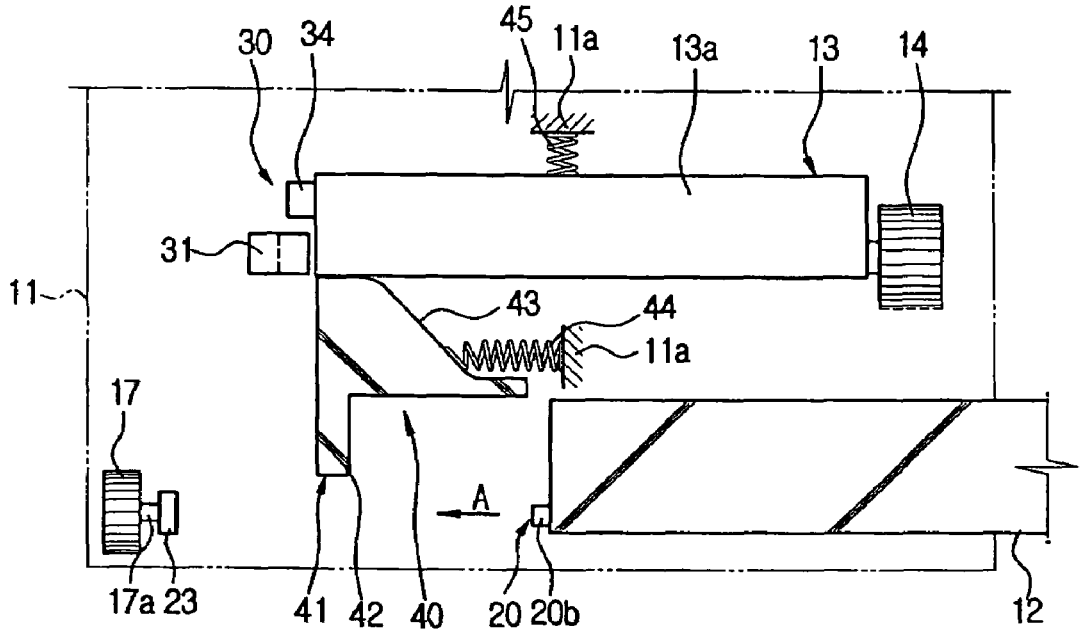
FIG. 2A (PRIOR ART)
FIGS. 2A and 2B are left side elevational views of the paper feeding apparatus of FIG. 1 illustrating movement of a pick-up roller lifting member of the paper feeding apparatus.
Figure 2B:
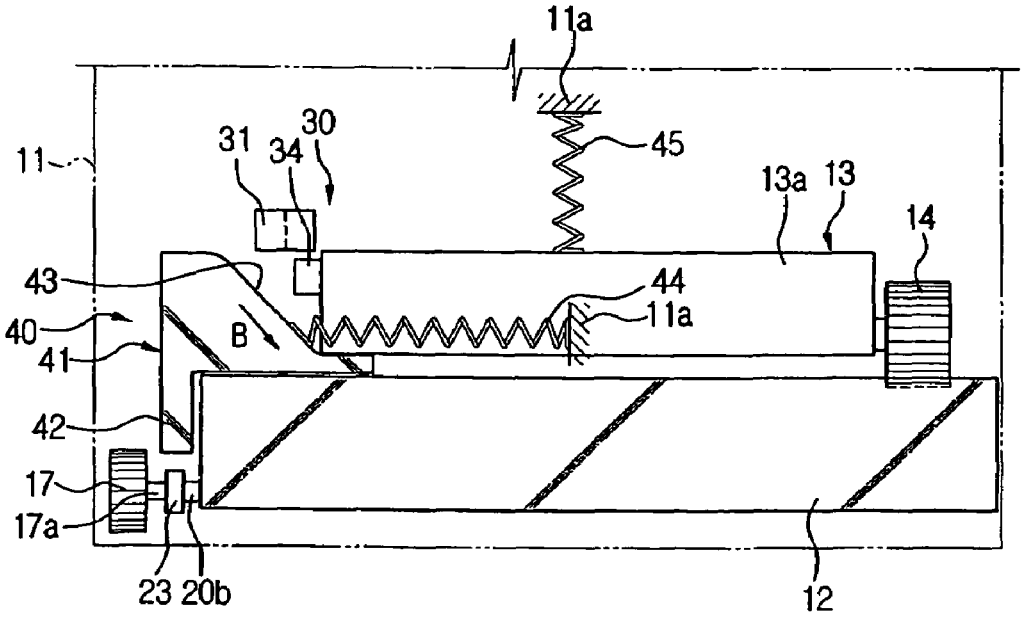
FIG. 2B (PRIOR ART)

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description such as a detailed construction and elements are intended to assist in a comprehensive understanding of the general inventive concept. Thus, it will be apparent that the present general inventive concept can be carried out without the details of the defined matters. Well-known functions and/or constructions are not described in detail since unnecessary detail would obscure the general inventive concept.

Figure 4:
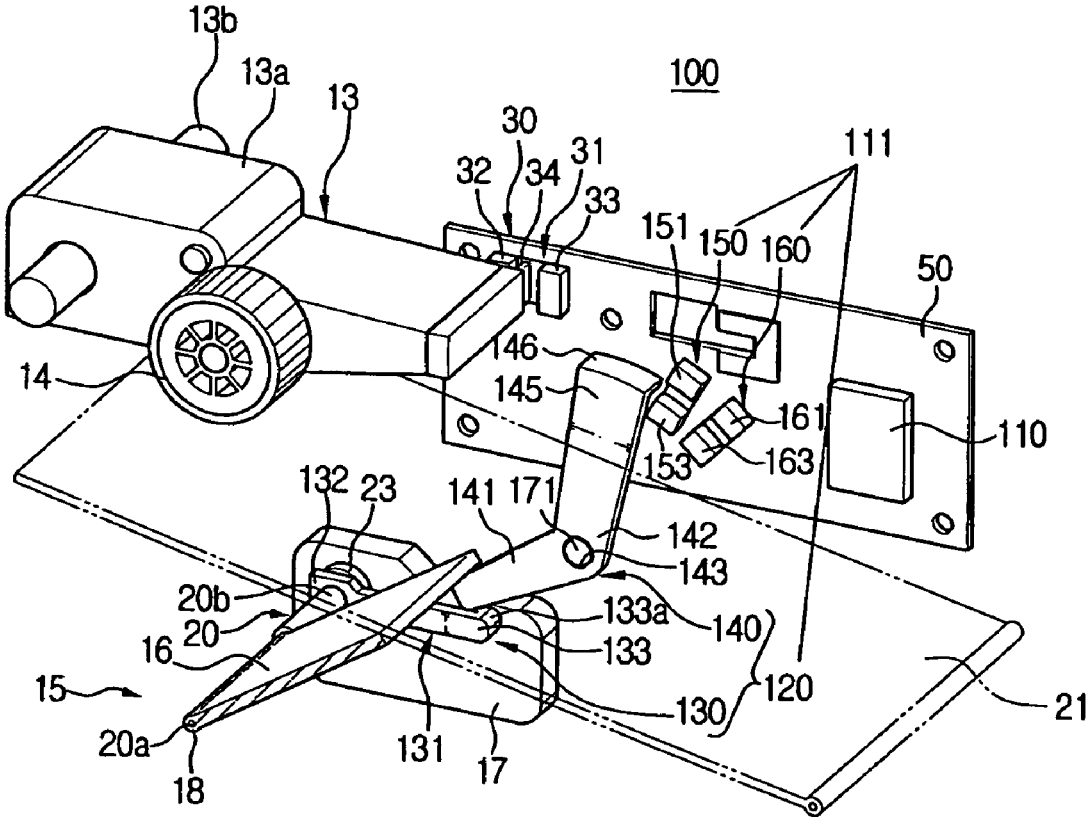
FIG. 4 is a perspective view illustrating a paper feeding apparatus of an image forming apparatus with a cassette being omitted according to the present general inventive concept.
Figure 5:
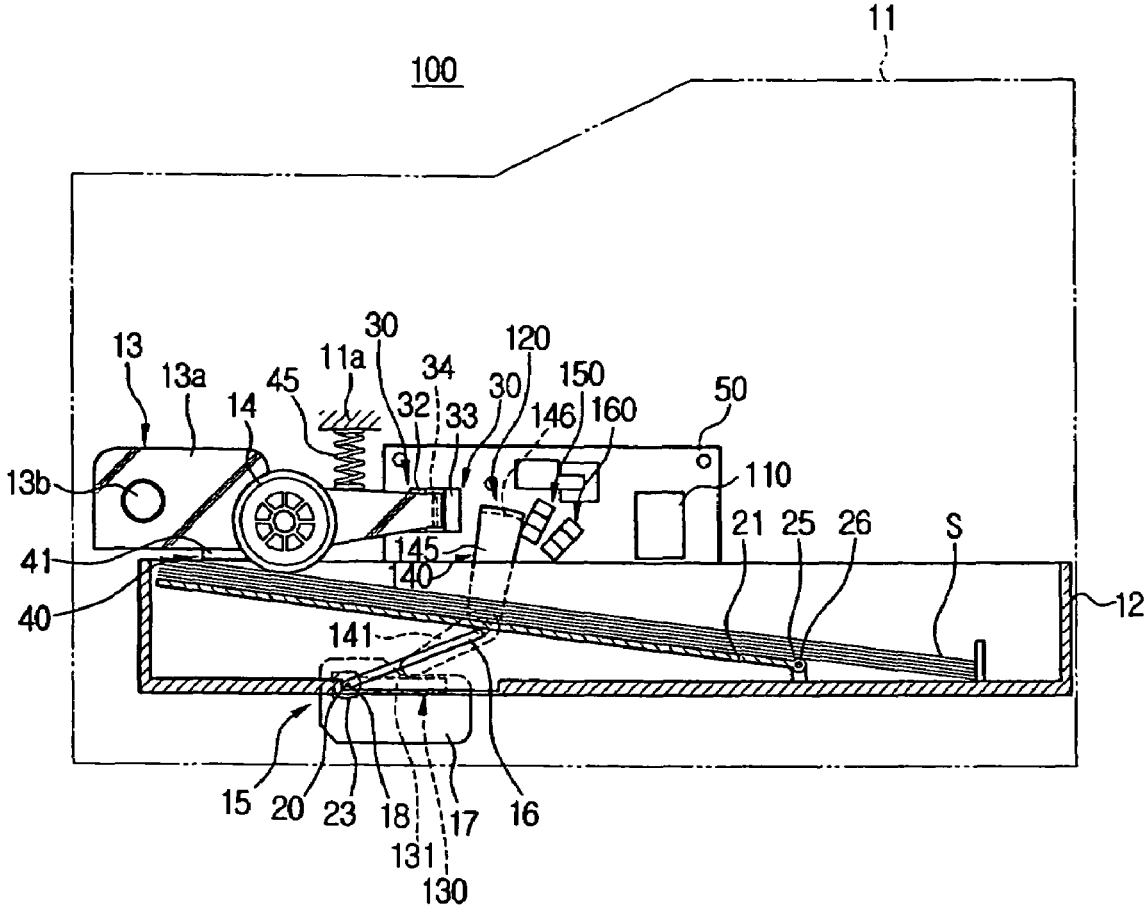
FIG. 5 is a partial section view of the paper feeding apparatus of FIG. 4.

FIGS. 4 and 5 illustrate a paper feeding apparatus 100 of an image forming apparatus according to an embodiment of the present general inventive concept.

The paper feeding apparatus 100 comprises a cassette 12 (FIG. 5) removably attached to a side of a body 11 of the paper feeding apparatus 100 and the cassette 12 is loaded with a plurality of sheets of paper S, a pick-up roller assembly 13 to form a paper feeding unit having a pick-up roller 14 to pick up and to feed the sheets of paper S loaded in the cassette 12 into the body 11 one by one, and a knock-up plate (paper loading plate) 21 to support the sheets of paper S within the cassette 12, the paper loading plate 21 being installed to be pivotable up and down to lift leading edges of the sheets of paper S toward the pick-up roller assembly 13. A pick-up roller lifting member 40 (FIG. 5) may lower the pick-up roller 14 of the pick-up roller assembly 13 toward the cassette 12 when the cassette 12 is installed in the body 11, and separate the pick-up roller 14 from the cassette 12 when the cassette 12 is removed from the body 11. A lifter 15 pivots the paper loading plate 21 toward the pick-up roller 14 so that an uppermost one of the sheets of paper S loaded on the paper loading plate 21 is positioned at a pick-up position, where the uppermost one of the sheets of paper S comes into contact with the pick-up roller 14 with a constant pressure. A position sensor unit 30 senses whether the uppermost one of the sheets of paper S is positioned at the pick-up position while the paper loading plate 21 is pivoted by the lifter 15. A paper quantity sensor unit 111 senses a quantity and/or a weight of the sheets of paper S loaded on the paper loading plate 21 while the paper loading plate 21 is pivoted by the lifter 15. A controller 110 controls a driving time period T of the lifter 15 until the pivotal movement of the lifter 15 is stopped after the position sensor unit 30 senses that the uppermost one of the sheets of paper S is in the pick-up position. The driving time period to control a driving motor 17, by placing a weight value, varies depending on the quantity and/or the weight of the sheets of paper S sensed by the paper quantity sensor unit 111.

All components of the paper feeding apparatus 100 except the paper quantity sensor unit 111 and the controller 110 (i.e., the cassette 12, the paper loading plate 21, the pick-up roller assembly 13, the pick-up roller lifting member 40, the lifter 15 and the position sensor unit 30) are similar to those of the conventional paper feeding apparatus 10 described with reference to FIGS. 1, 2A, 2B and 3. Therefore, the description of these components will be omitted.

The paper quantity sensor unit 111 comprises a sensing actuator 120 mounted in relation to the lifter 15, so that the sensing actuator 120 is moved by the lifter 15, and second and third optical sensors 150 and 160 mounted on a printed circuit board array (PBA) 50 fixed in the body 11 so that the second and third optical sensors 150 and 160 are operated by the sensing actuator 120.

As illustrated in FIGS. 6A to 6E, the sensing actuator 120 comprises an actuating lever 130 radially projecting from a second end 20*b* of a power transmission shaft 20, which is fixedly connected to a fixing part 18 of a lifting plate 16 at a first end 20*a*, and a second sensing lever 140 pivotally secured to a pivot axle 171 of a fixed bracket 170 in the body 11 so that the second sensing lever 140 is actuated by the actuating lever 130.

The actuating lever 130 includes a fixed end 132 secured to the second end 20*b* of the power transmission shaft 20 and a linear bar 131 having a projecting end 133 with a projection 133*a*.

The second sensing lever 140 comprises a first arm 141 disposed adjacent to the projecting end 133 of the actuating lever 130, a second arm 145 connected to the first arm 141 at an angle with respect to the first arm 141, and a center portion 142 having a pivot hole 143 to receive the pivot axle 171 of the fixed bracket 170. The second arm 145 has a sensing projection 146 projecting between second and third light emitting parts 151 and 161 and second and third light receiving parts 153 and 163 of the second and third optical sensors 150 and 160. The second and third optical sensors 150 and 160 will be described later. As described below, the sensing projection 146 turns the second and third optical sensors 150 and 160 "OFF" when the sensing projection blocks optical communication between the second and third light emitting parts 151 and 161 and the second and third light receiving parts 153 and 163, respectively; and/or "ON" when allowing optical communication to pass between the second and third light emitting parts 151 and 161 and the second and third light receiving parts 153 and 163, respectively, as the second sensing lever 140 pivots.

The sensing actuator 120 further comprises a sensing lever returning unit 180 to elastically bias the second sensing lever 140 in a direction for to cause the first arm 141 of the second sensing lever 140 to maintain contact with the projecting end 133 of the actuating lever 130. As a result, if the actuating lever 130 is pivoted in one direction (e.g., in the clockwise direction as shown in FIGS. 6A to 6E), the second sensing lever 140 is pivoted counterclockwise, and if the actuating lever 130 is then pivoted in the other direction (i.e. in the counterclockwise direction) thereby returning to its original position, the second sensing lever 140 is pivoted clockwise and returns to its original position.

The sensing lever returning unit 180 includes an elastic spring 181 arranged coaxial to the pivot axle 171 between the fixed bracket 170 and the second sensing lever 140. One end of the elastic spring 181 is supported by a first spring mount 172 formed on the fixed bracket 170 and the other end is supported by a second spring mount (not shown) formed on the second arm 145 or the center portion 142 of the second sensing lever 140.

The second and third optical sensors 150 and 160 are spaced from each other and comprise the second and third light emitting parts 151 and 161 and the second and third light receiving parts 153 and 163, respectively. The second and third light emitting parts 151 and 161 and the second and third light receiving parts 153 and 163 are mounted on the printed circuit board array 50 opposite to the sensing projection 146 of the second arm 145 of the second sensing lever 140 to be activated by the sensing projection 146.

The controller 110 is mounted on the printed circuit board array 50 and is electrically connected to a first optical sensor 31, the second and third optical sensors 150 and 160, the driving motor 17 of the lifter 15, and a pick-up roller driving motor (not shown) to drive the pick-up roller 14 of the pick-up roller assembly 13 so as to control the entire operation of the paper feeding apparatus 100.

In addition, the controller 110 determines a quantity and/or a weight of the sheets of paper S, according to a paper quantity sensing signal from the paper quantity sensor unit 111. The paper quantity sensing signal depends on whether the second and third optical sensors 150 and 160 are in an "ON" state or an "OFF" state. The sensing projection 146 of the second arm 145 of the second sensing lever 140 controls the "ON" and "OFF" states of the second and third optical sensors 150 and 160 until a point of time when the first optical sensor 31 of the position sensor unit 30 determines that the uppermost one of the sheets of paper S is in the pick-up position. The first optical sensor determines that the uppermost one of the sheets of paper S is in the pick-up position when a first sensing lever 34 of the first optical sensor 31 blocks optical communication between a first light emitting part 32 and a first light receiving part 33, thereby providing an "OFF" signal to the controller 110. The controller then determines the driving time period T of the driving motor 17 of the lifter 15 according to the determined quantity and/or the weight of the sheets of paper S, and then controls the driving motor 17 to be driven for the determined driving time period T.

The quantity and/or the weight of the sheets of paper S determined by the controller 110 may be determined in five ranges, e.g., below 25%, 25%, 50%, 75% and 100%, by the second and third optical sensors 150 and 160 of the paper quantity sensor unit. The driving time periods T of the driving motor 17 associated with these ranges indicated in Table 1 may be stored in a memory (not shown) of the controller 110. The driving time periods T associated with the ranges may be determined prior to operation of the paper feeding apparatus 100. For example, the driving time periods T may be determined by an experiment or a calibration process.

TABLE 1

| Quantity (or weight) of papers (S) | Driving time period T | Lifted height of paper loading plate |
|---|---|---|
| Below 25% | 0 ms | 0 mm |
| 25% | 10 ms | 0.5 mm |
| 50% | 20 ms | 1.0 mm |
| 75% | 30 ms | 1.5 mm |
| 100% | 40 ms | 2.0 mm |

Figure 6A:
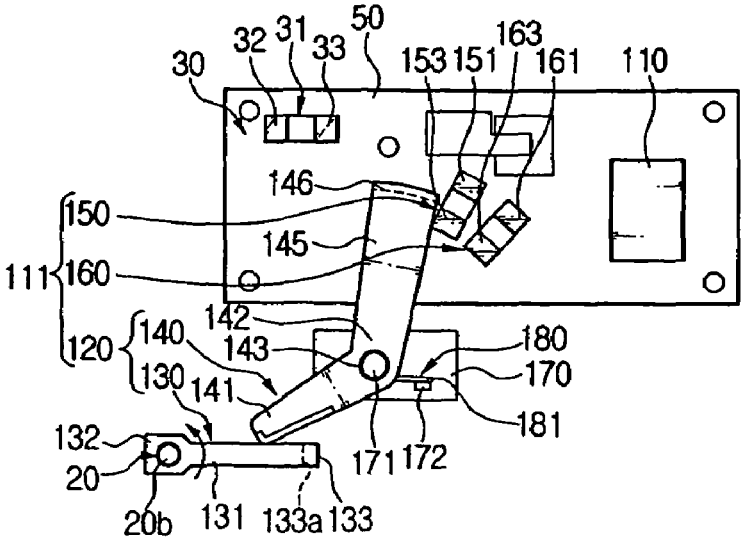
FIGS. 6A to 6E are front elevational views illustrating movements of a paper quantity sensor unit of the paper feeding apparatus of FIG. 4.

More specifically, as shown in FIG. 6A, the first optical sensor 31 of a position sensor unit 30 determines that the uppermost one of the sheets of paper S is in the pick-up position. pick- If the sensing projection 146 of the second arm 145 of the second sensing lever 140 is positioned, by the projecting end 133 of the actuating lever 130 secured to the second end 20*b* of the power transmission shaft 20, at a first position P1 where both of the second and third optical sensors 150 and 160 are not activated (i.e., in the "ON" state), the sensing projection 146 does not block optical communication of either of the second and third optical sensors 150 and 160. In other words, at a position where both of the second and third optical sensors 150 and 160 are turned "ON," the controller 110 determines that the quantity of sheets of paper S loaded on the paper loading plate 21 is below 25% of a maximum capacity of paper loadable on the paper loading plate 21 of the cassette 12, thereby controlling the driving motor 17 of the lifter 15 to be immediately stopped. When the second or third optical sensor 150 or 160 is not activated (in the ON state), the second or third optical sensor 150 or 160 outputs a first signal (ON signal) indicating the sensing projection 146 is not detected, and when the second or third optical sensor 150 or 160 is activated (in the OFF state), the second or third optical sensor 150 or 160 outputs a second signal (OFF signal) indicating the sensing projection 146 is detected.

Figure 6B:
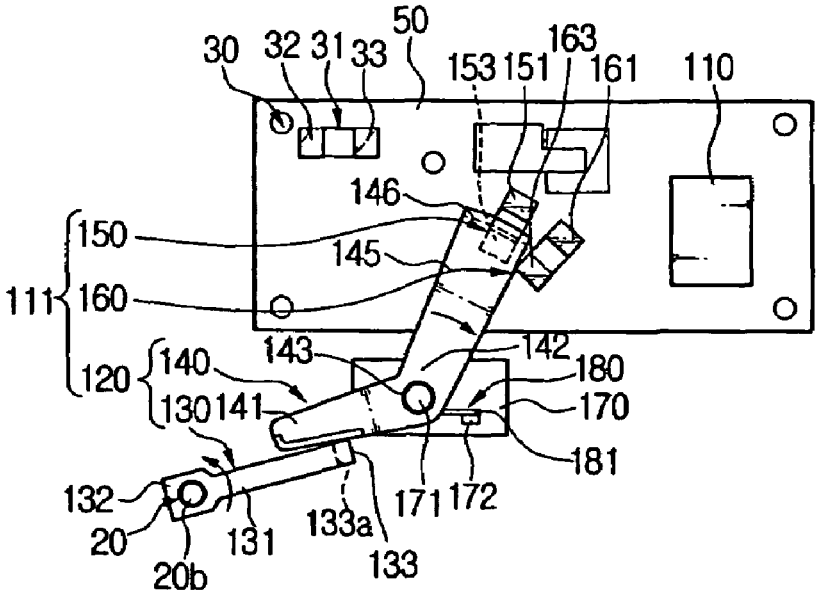

As illustrated in FIG. 6B, after the driving motor 17 of the lifter is driven, the first optical sensor 31 determines that the uppermost one of the sheets of paper S is in the pick-up position (i.e., the first optical sensor 31 is turned "OFF"). If the sensing projection 146 of the second arm 145 of the second sensing lever 140 is positioned, by the projecting end 133 of the actuating lever 130, at a second position P2 where the second optical sensor 150 is activated (i.e., in the "OFF" state) by the sensing projection 146, and the third optical sensor 160 is not activated (i.e., in the "ON" state), the controller 110 determines that the quantity of sheets of paper S loaded on the paper loading plate 21 is in the range of 25% of the maximum capacity of paper loadable on the paper loading plate 21 of the cassette 12, thereby controlling the driving motor 17 of the lifter 15 to be driven further for 10 milliseconds (0.01 seconds). In this event, the paper loading plate 21 is additionally lifted about 0.5 millimeters (mm) from a point in time when the first optical sensor 31 is turned "OFF."

Figure 6C:
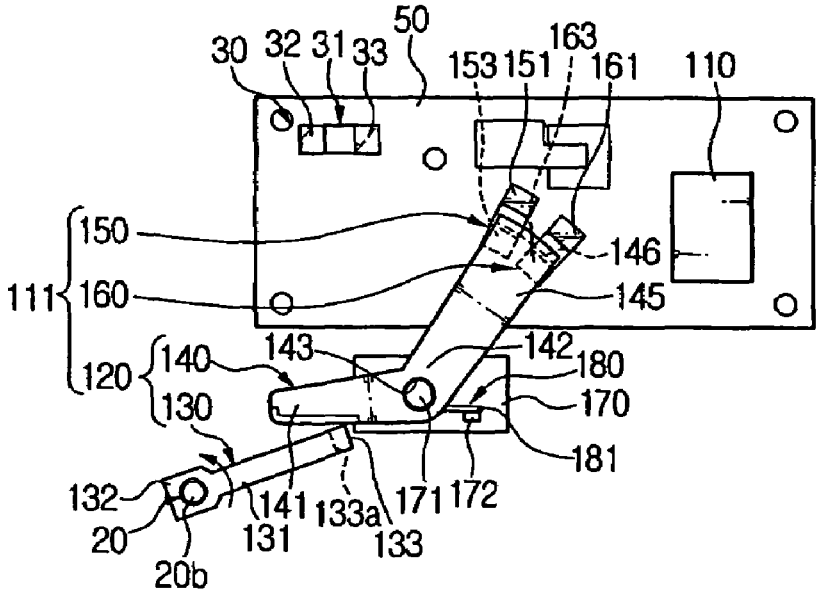

As illustrated in FIG. 6C, the first optical sensor 31 determines that the uppermost one of the sheets of paper S is in the pick-up position (i.e., the first optical sensor 31 is turned "OFF"). If the sensing projection 146 of the second arm 145 of the second sensing lever 140 is positioned, by the projecting end 133 of the actuating lever 130, at a third position P3 where both of the second and third optical sensors 150 and 160 are activated (i.e., in the "OFF" state) by the sensing projection 146, the controller 110 determines that the quantity of sheets of paper S loaded on the paper loading plate 21 is in the range of 50% of the maximum capacity of paper loadable on the paper loading plate 21 of the cassette 12, thereby controlling the driving motor 17 of the lifter 15 to be driven further for 20 milliseconds (0.02 seconds). In this event, the paper loading plate 21 is additionally lifted about 1.0 millimeters (mm) from a point in time when the first optical sensor 31 is turned "OFF."

Figure 6D:
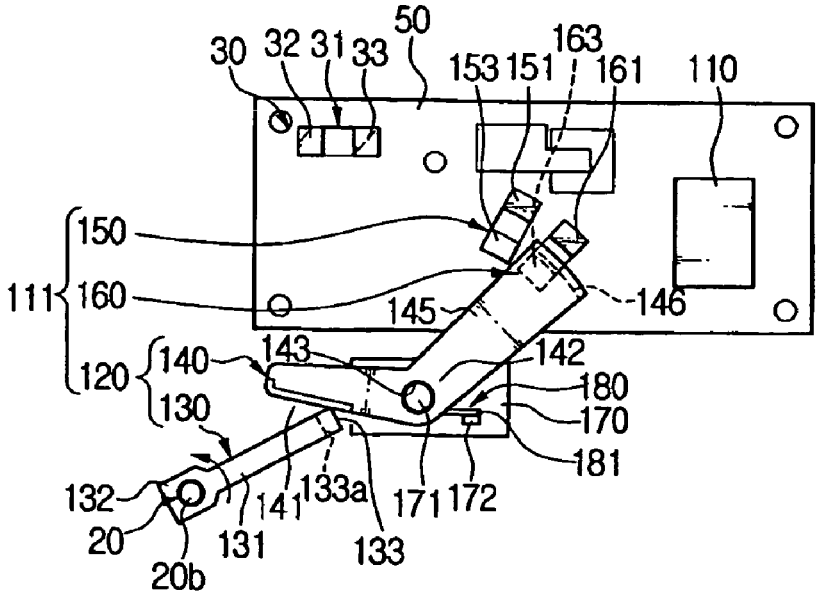

As illustrated in FIG. 6D, the first optical sensor 31 determines that the uppermost one of the sheets of paper S is in the pick-up position (i.e., the first optical sensor 31 is turned "OFF"). If the sensing projection 146 of the second arm 145 of the second sensing lever 140 is positioned, by the projecting end 133 of the actuating lever 130, at a fourth position P4 where the third optical sensor 160 is activated (i.e., in the "OFF" state) by the sensing projection 146, and the second optical sensor 150 is not activated (i.e., in the "ON" state), the controller 110 determines that the quantity of sheets of paper S loaded on the paper loading plate 21 is in the range of 75% of the maximum capacity of paper loadable on the paper loading plate 21 of the cassette 12, thereby controlling the driving motor 17 of the lifter 15 to be driven further for 30 milliseconds (0.03 seconds). In this event, the paper loading plate 21 is additionally lifted about 1.5 millimeters (mm) from a point in time when the first optical sensor 31 is turned "OFF."

Figure 6E:
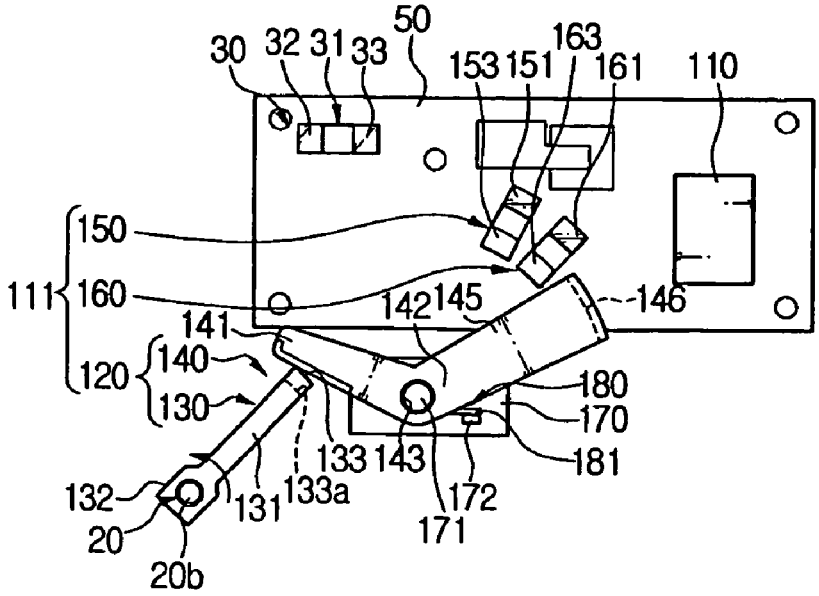
Figure 7:
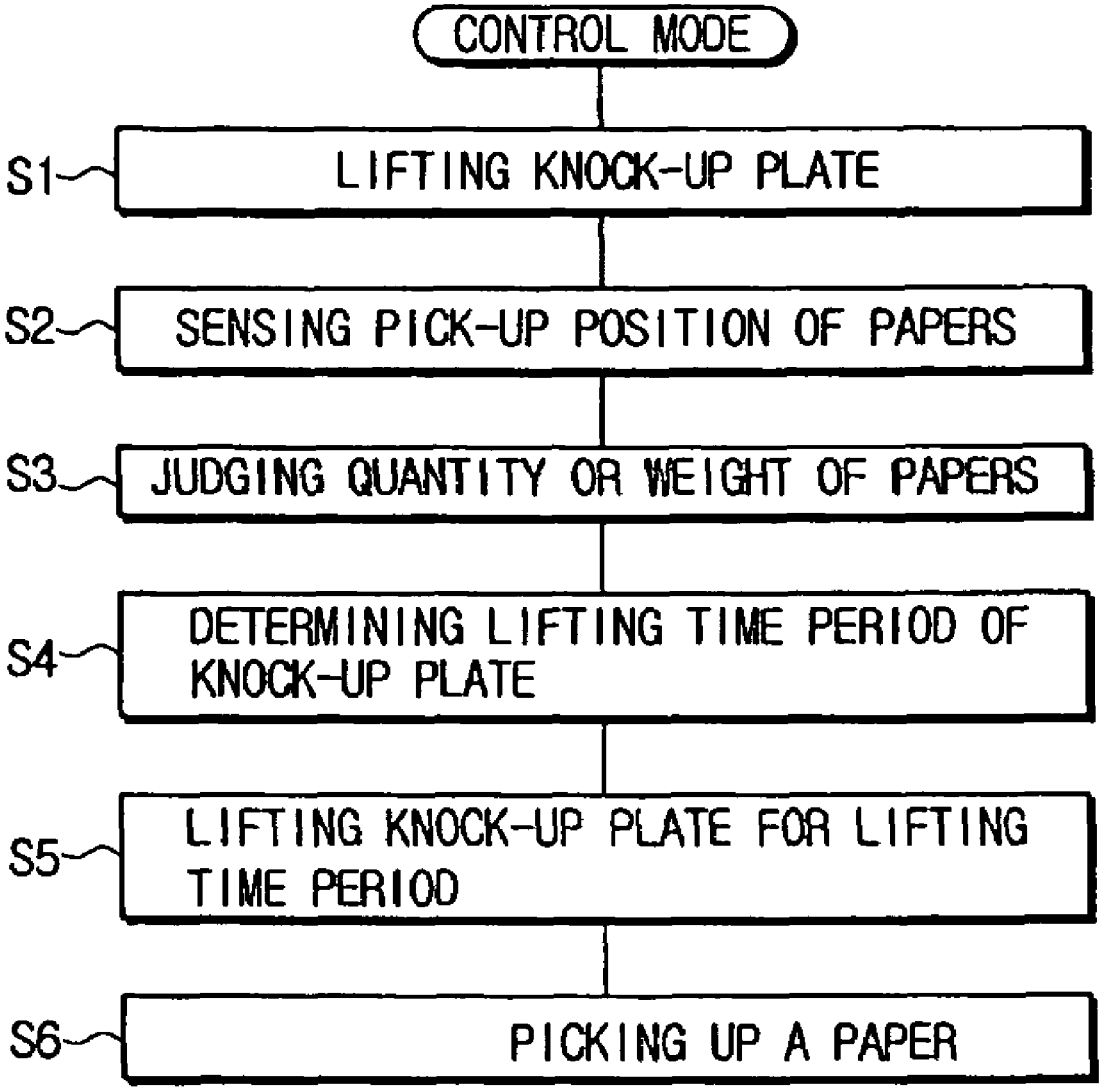
FIG. 7 is a flowchart illustrating a method of controlling the paper feeding apparatus of FIG. 4.

As illustrated in FIG. 6E, the first optical sensor 31 determines that the uppermost one of the sheets of paper S is in the pick-up position (i.e., the first optical sensor 31 is turned "OFF"). If the sensing projection 146 of the second arm 145 of the second sensing lever 140 is positioned, by the projecting end 133 of the actuating lever 130, at a fifth position P5 where both of the second and third optical sensors 150 and 160 are not activated (i.e., in the "ON" state) by the sensing projection 146, the controller 110 determines that the quantity of sheets of paper S loaded on the paper loading plate 21 is in the range of 100% of the maximum capacity of paper loadable on the paper loading plate 21 of the cassette 12, thereby controlling the driving motor 17 of the lifter 15 to be driven further for 40 milliseconds (0.04 seconds). In this event, the paper loading plate 21 is additionally lifted about 2.0 millimeters (mm) from a point in time when the first optical sensor 31 is turned "OFF."

The paper feeding apparatus 100 of an image forming apparatus according to the present general inventive concept controls the driving time period T until the driving motor 17 for driving the lifting plate 21 is stopped after the first photo sensor 31 of the position sensor unit 30 is turned "OFF" by placing a weight value, which is varied depending on the quantity and/or the weight of loaded sheets of paper S, whereby a contact pressure between the uppermost one of the sheets of paper S positioned at the pick-up position and the pick-up roller 14 can be maintained constant regardless of the quantity and/or the weight of the loaded sheets of paper S. As a result, jamming and overlapped feeding of papers can be prevented when picking up the loaded sheets of paper S from the cassette 12.

Although the paper feeding apparatus 100 has been exemplified and described above as having a paper quantity sensor unit 111 with two optical sensors 150 and 160, wherein the quantity and/or the weight of sheets of paper Sis determined to be in one of five ranges, and the driving motor 17 is controlled over five time periods T, the present general inventive concept is not limited to this arrangement. In other words, it should be understood that the paper feeding apparatus 100 according to the present general inventive concept can include any number of optical sensors and the quantity and/or the weight of the sheets of paper S can be determined to be in one of any number of ranges. For example, the paper feeding apparatus 100 can be arranged so that the paper quantity sensor unit 111 may comprise more or less than two optical sensors and thus determines the quantity and/or the weight of the sheets of paper S to be in more or less than five ranges, and thus the lifter 15 can be controlled over more or less than five driving time periods T.

In addition, although the paper quantity sensor 111 has been exemplified and described as having optical sensors 150 and 160 to sense the quantity and/or the weight of the sheets of paper S and to determine the driving time period T of the driving motor 17 of the lifter 15 based on the sensed quantity and/or weight, the present general inventive concept is not limited to this arrangement. In other words, the paper feeding apparatus can be arranged such that the paper quantity sensor unit 111 may be provided with a weight sensor (not shown) instead of the optical sensors 150 and 160 to sense the weight of sheets of paper S. Alternatively, the paper quantity sensor may be provided with the weight sensor in addition to the optical sensors 150, 160 to sense both of the quantity and the weight of the sheets of papers S and to determine the driving time period T of the driving motor 17 of the lifter 15 based on the sensed weight and/or the sensed quantity.

Now, a method of controlling the paper feeding apparatus 100 of the image forming apparatus according to the present general inventive concept is described with reference to FIGS. 4 to 7.

First, the cassette 12 loaded with the sheets of paper S is inserted into the body 11 in the same manner as in a conventional paper feeding apparatus 10 described above with reference to FIGS. 1 to 3. The paper loading plate 21 is then pivoted and lifted about a hinge axle 26 by the lifting plate 16 connected to a coupling 23 formed on a driving axle 17*a* of the driving motor 17 through the power transmission shaft 20 so that the uppermost one of the sheets of paper S comes into contact with the pick-up roller 14 (S1).

Figure 3:
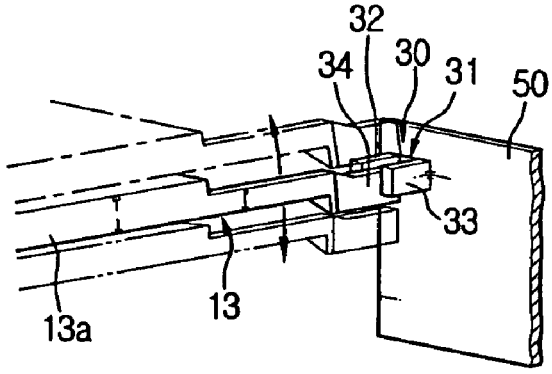
FIG. 3 (PRIOR ART)
FIG. 3 is a perspective view of a right side part of the paper feeding apparatus of FIG. 1 illustrating movement of a position sensor unit of the paper feeding apparatus.

As the paper loading plate 21 is lifted, the pick-up roller assembly 13 is upwardly pivoted along a pivot axle 13*b* by the sheets of paper S loaded on the paper loading plate 21 and positioned at a position where the uppermost one of the sheets of paper S comes into contact with the pick-up roller 14 with a constant pressure. As a result, the first sensing lever 34 projecting from an end of the body 13*a* of the pick-up roller assembly 13 is arranged between the light emitting part 32 and the light receiving part 33 of the first optical sensor 31 as illustrated in FIGS. 3 and 5, and thus the first optical sensor 31 produces "OFF" signal (S2).

If the first optical sensor 31 produces "OFF" signal, the controller 110 determines the quantity and/or the weight according to the "ON" and "OFF" signals produced by the second and third optical sensors 150 and 160 of the paper quantity sensor unit 111. The second and third optical sensors produce the "ON" and "OFF" signals when the second sensing lever 140 is pivoted by the actuating lever 130 disposed on the second end 20*b* of the power transmission shaft 20 (S3).

For example, as illustrated in FIGS. 6A to 6E, in at an instant that the first optical sensor 31 produces the "OFF" signal, if the second sensing lever 140 is positioned at the first, second, third, fourth or fifth position (P1, P2, P3, P4 or P5), the controller 110 determines that the quantity of sheets of paper S loaded on the paper loading plate 21 of the cassette 12 is in the range of below 25%, 25%, 50%, 70% or 100% of the capacity of paper loadable on the paper loading plate 21, respectively.

Next, the controller 110 determines the driving time period T from a point in time when the first optical sensor 31 of the position sensor unit 30 produces the "OFF" signal to a point in time when the driving motor 17 is turned off and stops the pivotal movement. In other words, the controller determines a lifting time period of the paper loading plate 21 according to the quantity and/or the weight of the sheets of paper S determined at operation S3 so that the larger the quantity and/or the weight, the longer the driving time period, and vice versa.

In the event, the driving time period T of the drive motor 17 is determined by selecting a value corresponding to the quantity and/or the weight of the sheets of paper S determined in operation S3 from among a plurality of values that have been previously set to correspond to a quantity or weight of the sheets of paper S capable of being loaded on the paper loading plate 21, and stored in the memory of the controller 110.

For example, if it is determined that the quantity of the sheets of paper S loaded on the paper loading plate 21 is in the range of below 25%, 25%, 50%, 75% or 100% of a quantity capable of being loaded on the paper loading plate, the controller determines the driving time period T by selecting a corresponding one of the plurality of values stored in the memory of the controller 110 (e.g., 0 milliseconds, 10 milliseconds, 20 milliseconds, 30 milliseconds, and 40 milliseconds) as the driving time period T.

After the driving time period T of the driving motor 17 is determined, the controller 110 further drives the driving motor 17 of the lifter 15 for the determined driving time period T to lift the paper loading plate 21, and then stops the driving motor 17 (S5).

For example, if the driving motor 17 is further driven for 10 ms, 20 ms, 30 ms or 40 ms, the paper loading plate 21 is additionally lifted 0.5 mm, 1.0 mm, 1.5 mm, or 2 mm, respectively, from the point in time when the first optical sensor 21 is turned "OFF" to the point in time when the driving motor 17 is turned off and stops the pivotal movement.

After the driving motor 17 is stopped, the controller 110 drives the pick-up roller 14 using a driving source (not shown) connected with the pick-up roller 14 through a gear train (not shown) so that the sheets of paper S in contact with the pick-up roller 14 are sequentially fed into the body 11 one by one beginning with the uppermost one of the sheets of paper S (S6).

The inventive paper feeding apparatus 100 controls the driving time period T of the driving motor 17 from the point in time when the first optical sensor 31 is turned "OFF" to the point of time when the driving motor 17 is turned off to stop the pivotal movement. In other words, the lifting time period of the paper loading plate 21 from the point in time where the first optical sensor 31 is turned off to a point in time when the paper loading plate 21 stops the lifting movement varies depending on the loaded quantity and/or weight of the sheets of paper S, and hence the lifted height of the paper loading plate 21 also varies depending on the loaded quantity and/or weight of the sheets of paper S. Accordingly, the contact pressure between the sheets of paper S and the pick-up roller 14 is maintained constant regardless of the loaded quantity and/or weight of the sheets of paper S. This prevents jamming of paper and overlapped feeding of papers.

As described above, the inventive paper feeding apparatus 100 of an image forming apparatus and a method of controlling the same controls the driving time period T of the lifter 15 from a point in time when the position sensor unit 30 senses the pick-up position to a point in time when the lifter 15 is stopped, by placing a weight value, which varies depending on of the quantity and/or weight sensed by the paper quantity sensor unit 111. As a result, the contact pressure between the sheets of paper S and the pick-up roller 14 is always maintained constant regardless of the loaded quantity or weight of the sheets of paper S, whereby jamming and overlapped feeding of papers can be prevented.

The position sensor unit 30 senses a relationship between the uppermost one of the sheets of paper S and the pickup roller 114, regardless of a rotation amount of the driving motor 17 and the lifter 15 with respect to a reference position, i.e., a bottom of the cassette 12. However, the paper quantity sensor unit 111 can sense the rotation amount of the driving motor 17 and the lifter 15 with respect to the reference position which represents the weight and quantity of papers S.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A paper feeding apparatus to feed papers in an image forming apparatus, the paper feeding apparatus comprising:

a paper loading plate having papers loaded thereon;

a pick-up unit pivotable about a pivot point to pick up an uppermost one of the papers loaded on the loading plate;

a lifter to lift the paper loading plate toward the pick-up unit;

a position sensor unit to determine when the paper loading plate is in a position such that the papers loaded on the paper loading plate are in a pick-up position;

a paper sensor unit to indicate an amount of the papers loaded on the paper loading plate according to a position of a movable arm to move with respect to the lifter and the paper loading plate; and a controller to control the lifter according to the determination of the position sensor unit and the indicated amount of the papers by the paper sensor unit.

2. The apparatus according to claim 1, wherein the controller determines one or more lifter driving parameters according to the indicated amount of the papers and to drive the lifter so that the papers loaded on the paper loading plate maintain a constant pressure with the pick-up unit during a paper feeding operation.

3. The apparatus according to claim 2, wherein the, one or more lifter driving parameters include a lifter driving time including an amount of time that the lifter should be driven from a first time when the position sensor determine that the papers loaded on the paper loading plate are in the pick-up position until a second time when the lifting by the lifter is stopped.

4. The apparatus according to claim 3, wherein the controller increases the lifter driving time when the indicated amount of the papers is greater than a reference value.

5. The apparatus according to claim 2, wherein the one or more lifter driving parameters include a lifting height to indicate an amount of displacement to be caused by the lifter during a lifting movement.

6. The apparatus according to claim 5, wherein the controller increases a lifter driving time when the indicated amount of the papers is greater than a reference value.

7. The apparatus according to claim 1, wherein the indicated amount of the papers is a percentage range of a maximum capacity of papers loadable on the loading plate.

8. The apparatus according to claim 7, wherein the controller determines whether the indicated amount corresponds to a range value previously stored in a controller memory.

9. The apparatus according to claim 1, wherein the paper sensor unit comprises a sensing lever coupled to the lifter and actuated in response to the lifter, and the sensing lever comprises a projection part extending there from.

10. The apparatus according to claim 9, wherein the paper sensor unit further comprises at least one optical sensor to be activated by the projection part when the sensing lever is actuated by the lifter.

11. The apparatus according to claim 10, wherein the indicated amount causes the lifter to actuate the sensing lever so that the projection part activates the at least one optical sensor.

12. The apparatus according to claim 10, wherein the at least one optical sensor includes at least one emitting part and at least one receiving part in communication with the at least one emitting part and the optical sensor is disposed so that the projection part passes in between the at least one emitting part and the at least one receiving part.

13. The apparatus according to claim 12, wherein the at least one optical sensor includes a first optical sensor having a first emitting part and a first receiving part and a second optical sensor adjacent to the first optical sensor and having a second emitting part and a second receiving part.

14. The apparatus according to claim 10, wherein the at least one optical sensor includes a first optical sensor and a second optical sensor, and the controller determines the indicated amount of the papers loaded on the paper loading plate according to a position of the projection part with respect to the first optical sensor and the second optical sensor.

15. The apparatus according to claim 14, wherein the projection part is disposed in a first position in which the projection part does not block either one of the first optical sensor and the second optical sensor, in a second position in which the projection part blocks the first optical sensor and does not block the second optical sensor, in a third position in which the projection part blocks both the first optical sensor and the second optical sensor, and in a fourth position in which the projection part does not block the first optical sensor or and blocks the second optical sensor.

16. The apparatus according to claim 14, wherein a first position of the projection part corresponds to a first indicated amount that is a first range value of a maximum capacity of papers for the loading plate, a second position of the projection part corresponds to a second indicated amount that is a second range value of the maximum capacity of papers for the loading plate, a third position of the projection part corresponds to a third indicated amount that is a third range value of the maximum capacity of papers for the loading plate, a fourth position of the projection part corresponds to a fourth indicated amount that is a fourth range value of the maximum capacity of papers for the loading plate and a fifth position of the projection part corresponds to a fifth indicated amount that is a fifth range value of the maximum capacity of papers loadable on the paper loading plate.

17. The apparatus according to claim 16, wherein the first through fifth range values are less than 25%, 25%, 50%, 75%, and 100%, respectively, of the maximum capacity of papers for the loading plate.

18. The apparatus according to claim 16, wherein the controller stores a plurality of predetermined lifter parameters that correspond to the first, second, third, fourth and fifth positions of the projection part and determines the one or more lifter parameters according to the position of the projection part with respect to the first optical sensor and the second optical sensor.

19. The apparatus according to claim 1, wherein the lifter is initially displaced by the indicated amount of the papers loaded on the paper loading plate.

20. The apparatus according to claim 1, further comprising:

a motor to drive the lifter; and a lever connected to the lifter to move with respect to the paper sensor unit, wherein the paper sensor unit comprises at least one sensor disposed along moving path of the lever to detect a location of the lever, and the controller controls the lifter according to a detected location of the lever.

21. The apparatus according to claim 20, further comprising:

a shaft coupled between the motor and the lifter to transmit a rotation force to the lifter, wherein the lever comprises an actuating lever fixedly coupled to the shaft to move together with the shaft, and a rotation lever disposed to move according to a movement of the actuating lever.

22. The apparatus according to claim 21, further comprising:

a sensing protrusion formed on the lever, wherein the at least one of sensor comprises a first sensor and a second sensor disposed on a moving path of the sensing protrusion.

23. The apparatus according to claim 22, wherein the first sensor and the second sensor each comprise a light emitting part and a light receiving part, and the sensing protrusion moves between the light emitting part and the light receiving part.

24. The apparatus according to claim 22, wherein the first sensor and the second sensor are spaced-apart from each other along the moving path of the sensing protrusion.

25. The apparatus according to claim 22, wherein the first sensor and the second sensor are disposed along the moving path of the sensing protrusion to detect a position of the lever.

26. The apparatus according to claim 20, wherein the at least one sensor comprises a first sensor and a second sensor, and the lever selectively activates at least one of the first and second sensor so that the indicated amount of the papers is detected according to the activation of the first and second sensors.

27. The apparatus according to claim 1, wherein the position sensor unit detects a first relationship between the papers and the pick-up unit by determining whether the paper loading plate is in the position such that the papers loaded on the paper loading plate are in the pick-up position, and the paper sensor unit detects a second relationship between the lifter and a reference position other than a location of the paper loading plate.

28. The apparatus according to claim 27, wherein the controller controls the lifter according to the first relationship and the second relationship.

29. A paper feeding apparatus to feed papers in an image forming apparatus, the paper feeding apparatus comprising:

a paper loading plate having papers loaded thereon;

a pick-up unit to pick up an uppermost one of the papers loaded on the loading plate;

a lifter to lift the paper loading plate toward the pick-up unit;

a position sensor unit to detect a first relationship between the pick-up unit and one of the papers which is in contact with the pick-up unit;

a paper sensor to detect a second relationship between the lifter and a reference position according to whether or not a moveable arm which moves with respect to at least one of the paper loading plate and the lifter as a function of the movement of the paper loading plate comes into close proximity to the paper sensor; and a controller to control the lifter according to the first relationship and the second relationship.

30. A paper feeding apparatus to feed paper to an image forming apparatus, the paper feeding apparatus comprising:

a loading part having papers stacked thereon to position the papers in a pick-up position with respect to a feeding part;

a paper sensing unit to indicate an amount of the papers stacked on the loading part according to whether one or more sensors disposed thereon detect a movable arm which is connected to the loading part and moves therewith with respect to the loading part as a function of movement of the loading part to be detected by the one or more sensors; and a controller to determine one or more loading part movement parameters according to the indicated amount of the papers and to control the loading part so that the papers loaded on the loading part maintain a constant pressure with the feeding part during a paper feeding operation.

31. The apparatus according to claim 30, wherein the one or more loading part movement parameters include at least one of a loading part moving time including an amount of time that the loading part should be moved toward the feeding part from a time that the paper feeding operation begins until a time when movement of the loading part is stopped, and a loading part height to indicate an amount that the loading part should be displaced toward the feeding part during the paper feeding operation.

32. A method of a paper feeding apparatus, the method comprising:

positioning a paper loading plate having papers disposed thereon to a pick-up assembly;

determining an amount of the papers disposed on the paper loading plate by determining a position of a moveable arm which moves with respect to the paper loading plate as a function of the movement of the paper loading plate and is sensed by at least one of a plurality of optical sensors to indicate the amount of the papers disposed on the paper loading plate;

retrieving one or more lifter driving parameters corresponding to the determined amount of the papers from a memory;

controlling the lifter to lift the paper loading plate so that the papers loaded on the paper loading plate maintain a constant pressure with the pick-up roller during a paper feeding operation; and feeding the papers into a body of an image forming apparatus using the pick-up assembly.

33. The method according to claim 32, wherein the positioning of the paper loading plate to a pick-up assembly comprises pivoting a lifting plate disposed below the paper loading plate using a driving motor so that a pick-up roller of the pick-up assembly is in a position to pick up the papers beginning with an uppermost one of the papers.

34. The method according to claim 32, further comprising:

before retrieving the one or more lifter driving parameters, determining whether an uppermost one of the papers is in a pick-up position with respect to the pick-up assembly.

35. The method according to claim 32, wherein the determining of the determined amount of the papers disposed on the paper loading plate comprises measuring an amount of displacement of a sensing lever that is actuated in response to an initial displacement of the lifter using at least one optical sensor, the initial displacement of the lifter being proportional to the determined amount of the papers.

36. The method according to claim 35, wherein the determining of the determined amount of the papers disposed on the paper loading plate further comprises determining a position of the sensing lever with respect to at least two optical sensors, the position of the sensing lever indicating an amount of initial displacement of the lifter.

37. The method according to claim 32, wherein the retrieving of one or more lifter driving parameters comprises retrieving at least one of a lifter driving time including an amount of time that the lifter should be driven from a time when the papers loaded on the paper loading plate are in a pick-up position with respect to the pick-up assembly until a time when the lifting by the lifter is stopped, and a lifting height to indicate an amount of displacement to be caused by the lifter during a lifting movement.

38. The method according to claim 37, wherein the retrieving of one or more lifter driving parameters further comprises determining a fractional range of a maximum capacity of paper loadable on the paper loading plate corresponding to the determined amount of the papers and selecting a set of lifter driving parameters that corresponds to the fractional range from a plurality of sets of lifter driving parameters.

39. The method according to claim 38, wherein the fractional range is selected from one of below 25%, 25%, 50%, 75%, and 100%.

40. The method according to claim 39, wherein the retrieving of one or more lifter driving parameters further comprises selecting a lifting time that corresponds to the fractional range, wherein the lifting is selected from 0 milliseconds, 10 milliseconds, 20 milliseconds, 30 milliseconds and 40 milliseconds.

41. A method of a paper feeding apparatus, the method comprising:

loading papers on a paper loading plate;

picking up an uppermost one of the papers loaded on the loading plate with a pick-up unit;

lifting the paper loading plate toward the pick-up unit;

detecting a first relationship between the pick-up unit, which picks up an uppermost one of the papers loaded on the loading plate, and the upper most one of the papers;

detecting using two or more sensors a second relationship between a lifter, which lifts the paper loading plate toward the pick-up unit, and a position of a moveable sensing lever to which rotates with respect to the lifter and the sensors; and controlling the lifter according to the first relationship and the second relationship.

42. A method of a paper feeding apparatus, the method comprising:

lifting a loading part having papers thereon to position the papers in a pick-up position with respect to a feeding part;

sensing an amount of the papers loaded on the loading part using a sensor by sensing a position of a sensing lever which moves in a non-linear manner with respect to the loading part and the sensor; and determining one or more loading part movement parameters according to the sensed amount of the papers and to control the loading part so that the papers loaded on the loading part maintain a constant pressure with the feeding part during a paper feeding operation.

43. A paper feeding apparatus to feed papers in an image forming apparatus, the paper feeding apparatus comprising:

a paper loading plate having papers loaded thereon:

a pick-up unit having a pickup roller biased toward the papers loaded on the paper loading plate;

a lifter to lift the paper loading plate toward the pickup roller;

a movable arm to move with respect to the lifter according to a movement of the lifter;

a plurality of sensors to detect a position of the pickup roller with respect to the paper loading plate and to detect a position of the movable arm with respect to the paper loading plate and the sensor; and a controller to control the lifter according to the detected position of the pickup roller and the detected position of the movable arm.

44. The paper feeding apparatus of claim 43, further comprising:

a cassette having the paper loading plate disposed therein; and a member to bias the pickup roller toward an inside of the cassette to contact an uppermost one of the papers loaded on the paper loading plate and to separate the pickup roller from the cassette.

45. The paper feeding apparatus of claim 43, wherein the sensor comprises:

a position sensor to detect a movement of the pickup roller as the position of the pickup roller with respect to the paper loading plate; and a paper sensor unit to detect a movement of the movable arm as the position of the movable arm with respect to the paper loading plate and the sensor according to a movement of the lifter.

46. The paper feeding apparatus of claim 45, wherein the position sensor and the paper sensor unit are disposed on a single printed circuit board.

47. The paper feeding apparatus of claim 43, wherein the controller controls the lifter according to a combination of the detected position of the pickup roller and the detected position of the movable arm.

* * * * *